US010009964B2

(12) United States Patent
Schlötterer-Fratoianni et al.

(10) Patent No.: US 10,009,964 B2
(45) Date of Patent: Jun. 26, 2018

(54) OVEN DOOR FOR A MICROWAVE OVEN

(71) Applicant: Electrolux Appliances Aktiebolag, Stockholm (SE)

(72) Inventors: Klaus Schlötterer-Fratoianni, Rothenburg ob der Tauber (DE); Arnd Hofmann, Rothenburg ob der Tauber (DE); Trevor Specht, Rothenburg ob der Tauber (DE); Mario Weber, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days. days.

(21) Appl. No.: 15/548,129

(22) PCT Filed: Dec. 9, 2015

(86) PCT No.: PCT/EP2015/079052

§ 371 (c)(1),
(2) Date: Aug. 2, 2017

(87) PCT Pub. No.: WO2016/128088

PCT Pub. Date: Aug. 18, 2016

(65) Prior Publication Data

US 2018/0020511 A1 Jan. 18, 2018

(30) Foreign Application Priority Data

Feb. 11, 2015 (EP) ..... 15154584

(51) Int. Cl.
*H05B 6/76* (2006.01)
*H05B 6/64* (2006.01)

(52) U.S. Cl.
CPC ..... *H05B 6/763* (2013.01)

(58) Field of Classification Search
CPC .... H05B 6/6405; H05B 6/763; H05B 6/6414; H05B 6/6426
(Continued)

(56) References Cited

U.S. PATENT DOCUMENTS 4,794,218 A * 12/1988 Nakano ..... H05B 6/763 219/742
5,942,144 A * 8/1999 Lee ..... H05B 6/766 219/738

FOREIGN PATENT DOCUMENTS

DE 2853616 A1 7/1979
EP 0184069 A1 6/1986
EP 2271177 A1 1/2011

OTHER PUBLICATIONS

International Search Report and Written Opinion in PCT/EP2015/079052 dated Feb. 19, 2016, 7 pages.

* cited by examiner

*Primary Examiner* — Quang Van
(74) *Attorney, Agent, or Firm* — Pearne & Gordon LLP

(57) ABSTRACT

The present invention relates to an oven door for a microwave oven or for an oven with microwave heating function. The oven door includes a wave choke system formed as a door frame or within a door frame of the oven door. The wave choke system (20) encloses a see-through area of the oven door. The wave choke system includes a frame part and several wave choke elements. The frame part includes a base plate. The wave choke elements are fastened on the base plate (24). The base plate is arranged parallel to a main plane of the oven door. The wave choke elements are serially arranged along the frame part and at least partially enclose the see-through area of the oven door. The wave choke element is formed as a U-shaped metal stripe. The series of wave choke elements on the base plate form a wavelike
(Continued)

Figure 3:
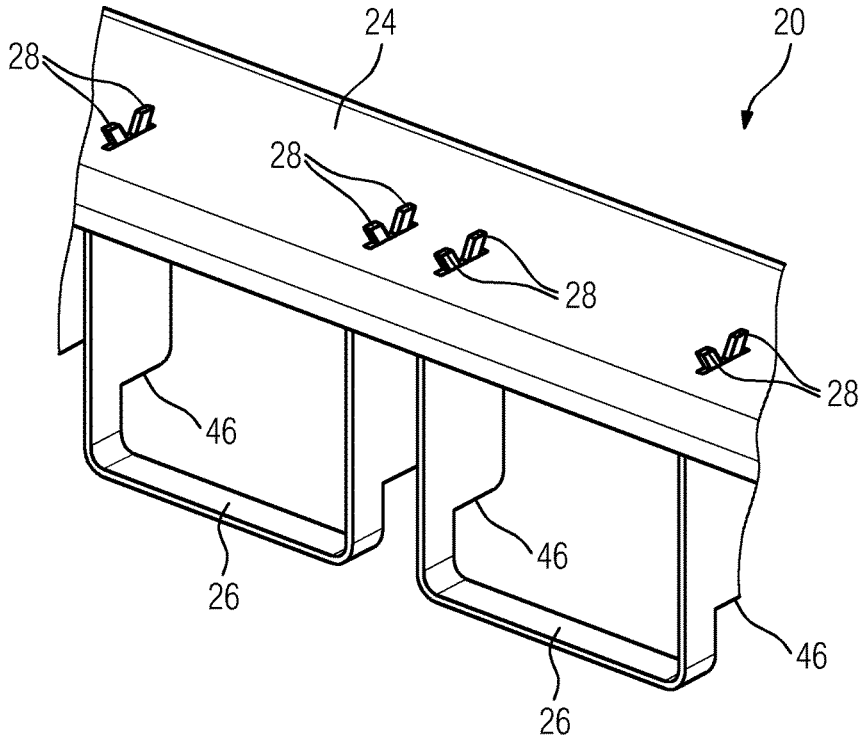

ribbon. A notch is formed in the central portion of the wave choke element, so that the central portion of the wave choke element is smaller than the open end portion of the wave choke element. The notches of the wave choke elements are provided for receiving an inner glass panel of the oven door. At least two neighbored wave choke elements are arranged along the same side of the oven door include aligned notches for receiving the same edge of the inner glass panel. Further, the present invention relates to a wave choke system for an oven door of a microwave oven or of an oven with microwave heating function. Moreover, the present invention relates to a microwave oven or an oven with microwave heating function.

22 Claims, 3 Drawing Sheets

(58) Field of Classification Search
USPC ..... 219/738, 739, 740, 741, 742, 743, 744; 126/198, 200
See application file for complete search history.

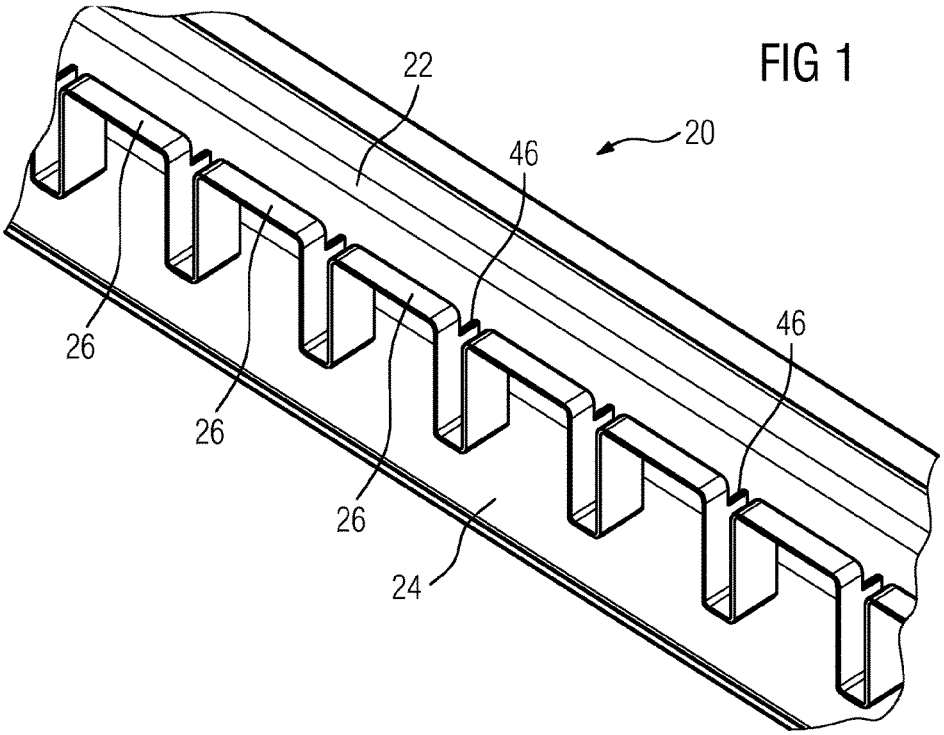
FIG 1
FIG 2
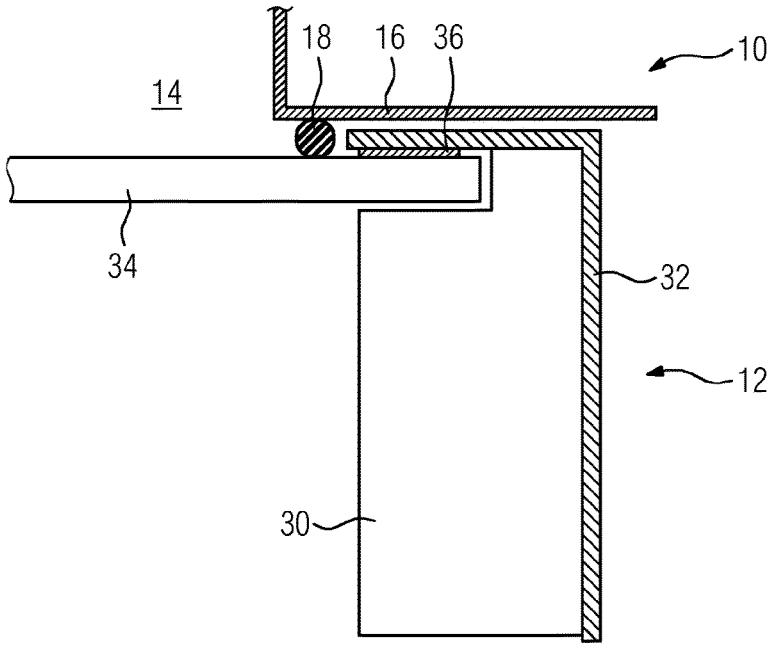

OVEN DOOR FOR A MICROWAVE OVEN

The present invention relates to an oven door for a microwave oven or for an oven with microwave heating function comprising a wave choke system according to the preamble of claim 1. Further, the present invention relates to a corresponding microwave oven or an oven with microwave heating function, respectively, comprising an oven door with a wave choke system.

The strong electro-magnetic fields generated by microwave ovens are dangerous for the health of the user. Several safety means are provided to keep the electro-magnetic fields inside the microwave oven. Special attention is paid to the front of the oven door and the gap between the oven door and front frame. The front of the oven door is usually shielded by perforated sheet metal, expanded metal or another type of metallic surfaces with periodic openings allowing the view through the oven door. A big see-through area within the oven door would be advantageous. The dimensions of the see-through area in the oven door are limited, since an outer portion of the oven door is required for a wave choke. Said wave choke blocks the circumferential gap between the oven door and front frame against the electro-magnetic fields inside the microwave oven. Said gap has a defined width. However, fat and other pollution deposited therein may alter the width of the gap. This may impair the function of the wave choke. For a maximum attenuation of the electro-magnetic fields, the width of the gap is about 1 mm or smaller. The small gap makes it difficult to arrange a silicone gasket therein. The silicone gasket would effectively keep heat, moist, vapour and other products of the food treatment inside the oven cavity.

Therefore it would desirable to have a mechanically robust and compact wave choke system with high microwave leakage suppression and maximum visual area of the oven door. The market trend of enlarging the oven cavity, while the outer dimensions remains constant, requires a compact wave choke system. Also the front frame becomes smaller. The metallic surface of the front frame acts as a counterpart to the wave choke system. The larger the surface of the front frame with respect to the wave choke system, the more effective is the microwave leakage suppression with respect to conventional wave choke concepts.

DE 28 53 616 A1 discloses an oven door with a wave choke system for a microwave oven. The wave choke system comprises a frame part and a wavelike metal band. The wavelike metal band is attacked at the frame part. The frame part and the wavelike metal band enclose at least partially the oven door.

It is an object of the present invention to provide an oven door for a microwave oven with an improved wave choke system, which is mechanically robust and compact and allows a relative large visual area within the oven door.

According to the present invention a notch is formed in the central portion of the wave choke element, so that the central portion of the wave choke element is smaller than the open end portion of said wave choke element, wherein the notches of the wave choke elements are provided for receiving an inner glass panel of the oven door, and wherein at least two neighboured wave choke elements arranged along the same side of the oven door include aligned notches for receiving the same edge of the inner glass panel.

The core of the present invention is the geometric structure of the wave choke system on the one hand and the arrangements of the wave choke elements on the base plate on the other hand. The wave choke elements allow a very high accuracy. The notches allow a relative large inner glass panel resulting in a large see-through area of the oven door. The wave choke system may be produced by low costs. The notches of the wave choke elements provided for receiving the inner glass panel of the oven door contribute to a compact structure of the oven door. At least two neighboured wave choke elements arranged along the same side of the oven door include aligned notches for receiving the same edge of the inner glass panel.

Further, the oven door may comprise a door cover extending over an outer portion of the inner side of said oven door.

For example, the door cover of the oven door is formed as an L-shaped profile part and extends further over at least partially the circumferential sides of the oven door.

Additionally, the present invention relates to a corresponding microwave oven or an oven with microwave heating function comprising an oven door with a wave choke system mentioned above.

In particular, the microwave oven or the oven with microwave heating function, respectively, comprises a front frame enclosing a front opening of an oven cavity, wherein said front frame is made of metal and forms a counterpart of the wave choke system.

Preferably, the door cover and an outer portion of the inner glass panel of the oven door are arranged in front of the front frame in a closed state of said oven door.

In particular, a gap is formed between the front frame on the one hand and the door cover and the outer portion of the inner glass panel on the other hand in said closed state of the oven door.

Moreover, the width of a gap between the microwave oven and the oven door is suitable for receiving an elastic gasket being thick enough for acting as a steam-tight seal. In particular the width of said gap is between 2 mm and 4 mm, preferably about 3 mm, in the closed state of the oven door. This width of the gap allows further cooking function, e.g. steam cooking and/or pyrolytic cleaning.

Further, the front frame may form the counterpart of the wave choke system of the oven door, so that microwaves penetrating between the front frame and the oven door are conducted to the wave choke system.

In particular, the wave choke elements extend from the base plate in the direction of the inner side of the oven door.

For example, the wave choke element includes two open end portions and the base plate includes a series of slots, wherein each open end portion of the wave choke element penetrates one slot of the base plate.

In this case, the open end of the wave choke element includes at least one tab, preferably at least two tabs, penetrating through the corresponding slot in the base plate.

The wave choke element may be fastened at the base plate by deformation of the at least one tab and/or by twisting the at least one tab and/or by welding the open end portions at said base plate.

At last, the microwave oven or the oven with microwave heating function, respectively, comprises at least one gasket, wherein said gasket is clamped between the front frame and the outer portion of the inner glass panel in a closed state of the oven door, wherein preferably the gasket is made of silicone. This structure restricts the pollution of the gap.

Novel and inventive features of the present invention are set forth in the appended claims.

Figure 4:
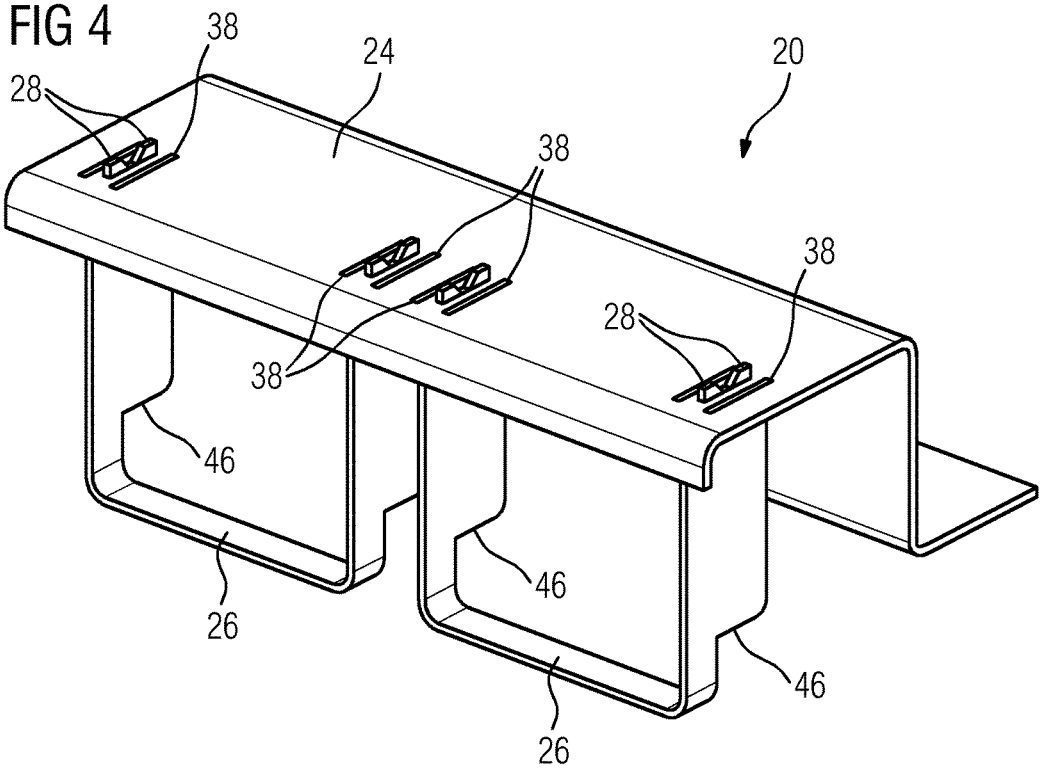
Figure 5:
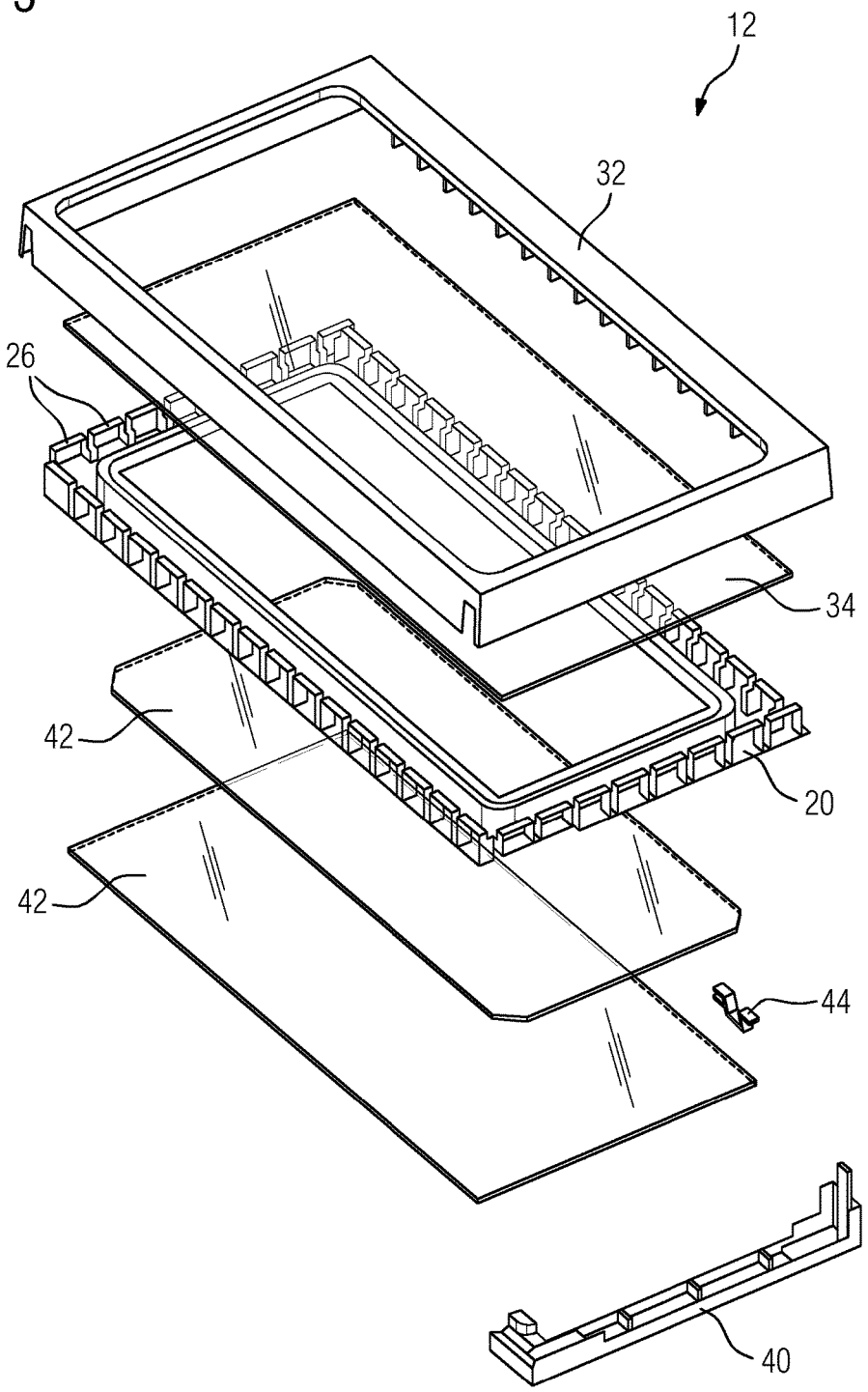

The present invention will be described in further detail with reference to the drawing, in which FIG. 1 illustrates a schematic partial perspective view of a wave choke system of an oven door for a microwave oven according to a preferred embodiment of the present invention, FIG. 2 illustrates a schematic partial sectional top view of the oven door for the microwave oven according to the preferred embodiment of the present invention, FIG. 3 illustrates a schematic partial perspective view of the wave choke system of the oven door for the microwave oven according to the preferred embodiment of the present invention, FIG. 4 illustrates a schematic partial perspective view of the wave choke system of the oven door for the microwave oven according to the preferred embodiment of the present invention, and FIG. 5 illustrates a schematic exploded top view of the oven door for the microwave oven according to the preferred embodiment of the present invention.

FIG. 1 illustrates a schematic partial perspective view of a wave choke system 20 of an oven door 12 for a microwave oven 10 according to a preferred embodiment of the present invention.

The wave choke system 20 includes a frame part 22 and a plurality of wave choke elements 26. In this example, the frame part 22 is a Z-shaped profile part. The frame part 22 includes a base plate 24, on which the wave choke elements 26 are fastened. Each wave choke element 26 is a U-shaped metal stripe. The wave choke elements 26 are serially arranged along the frame part 22, so that the series of the wave choke elements 26 forms a wavelike structure. The base plate 24 of the frame part 22 includes a series of slots. Each slot is provided for receiving an open end portion of the U-shaped wave choke element 26. Each wave choke element 26 includes two end portions penetrating one slot in each case.

Further, a notch 46 is formed in the central portion of each wave choke element 26. Surprisingly, it has been discovered that the wave choke element 26 may be notched without any noticeable reduction of the microwave leakage suppression of the wave choke system 20.

FIG. 2 illustrates a schematic partial sectional top view of the oven door 12 for the microwave oven 10 according to the preferred embodiment of the present invention.

The microwave oven 10 comprises an oven cavity 14 and a front frame 16. Said front frame 16 encloses a front opening of the oven cavity 14. The front opening of the oven cavity 14 is closable by the oven door 12. FIG. 2 shows the closed state of the oven door 12.

The oven door 12 comprises a choke section 30, a door cover 32 and an inner glass panel 34. The choke section 30 and the door cover 32 form a rectangular frame of the oven door 12. The door cover 32 is an L-shaped profile part. On the one hand the door cover 32 forms the circumferential side of the oven door 12. On the other hand the door cover 32 forms an outer portion of the inner side of the oven door 12. A glue joint 36 connects the door cover 32 to the inner glass panel 34.

A gap between the front frame 16 of the microwave oven 10 and the oven door 12 is sealed by a gasket 18. Said gasket 18 is clamped between the inner glass panel 34 of the oven door 12 and the front frame 16 of the microwave oven 10. For example, the gasket 18 is made of silicone.

The choke section 30 is formed by the wave choke system 20 or is provided for receiving said wave choke system 20. The choke section 30 and/or the wave choke system 20 form a rectangular frame enclosing the oven door 12. The base plate 24 of the frame part 22 extends parallel to the main plane of the oven door 12. The wave choke elements 26 extend from the base plate 24 in the direction of the inner side of the oven door 12.

The notches 26 formed in each wave choke element 26 allow a larger area of the inner glass panel 34, since the inner glass panel may extend into the notches 26. Thus, the gasket 18 can touch the inner glass panel 34 instead of the door cover 32. This improves the cleanability of the oven door 12, since the door cover 32 and its edges cannot be polluted. Further, the glue joint 36 between the door cover 32 and the inner glass panel 34 is arranged out of the high temperature region enclosed the by gasket 18. Thus, the glue joint 36 is in a relative cool region reducing heat stress onto the glue. The gasket 18 protects the glue joint 36 and the door cover 32 against excess of heat. Thus, the glue joint 36 and the door cover 32 may be made of materials with a relative low heat resistance, which are less expensive.

The notches 26 of the wave choke elements 26 allow a bigger distance between the front frame 16 and the surface sealed by the gasket 18. For example, the gap sealed by the gasket 18 may be about 3 mm. This relative large distance allows a more flexible design of the gasket 18. Moreover, the relative large gap allows further cooking functions, for example steam cooking or pyrolytic cleaning.

FIG. 3 illustrates a schematic partial perspective view of the wave choke system 20 of the oven door 12 for the microwave oven 10 according to the preferred embodiment of the present invention. In FIG. 3 the wave choke elements 26 extend downwards from the base plate 24 and are in a pre-assembled state.

Each open end portion of the wave choke element 26 includes two tabs 28 penetrating through the slot in the base plate 24. The wave choke elements 26 are fastened on the base plate 24 by deforming the tabs 28. In the pre-assembled state shown in FIG. 3 the tabs 28 are not yet deformed.

FIG. 4 illustrates a schematic partial perspective view of the wave choke system 20 of the oven door 12 for the microwave oven 10 according to the preferred embodiment of the present invention. In FIG. 4 the wave choke elements 26 extend downwards from the base plate 24 and are in an assembled state. The tabs 28 are deformed, so that the wave choke elements 26 are fastened on the base plate 24. For example, the tabs 28 are twisted and/or stamped. Alternatively or additionally, the wave choke elements 26 are connected to the frame part 22 by laser welding. A firm fixation of the wave choke elements 26 on the frame part 22 allows a minimum electric resistance between the frame part 22 and the wave choke elements 26 and a mechanical stability of the wave choke system 20.

Further, the base plate 24 includes reinforcements 38. Preferably, the reinforcements 38 are elongated and extend parallel to the slots penetrated by the tabs 28. In this example, two reinforcements 38 are arranged beside each slot, so that the slot is between two parallel reinforcements 38.

FIG. 5 illustrates a schematic exploded top view of the oven door 12 for the microwave oven 10 according to the preferred embodiment of the present invention.

The oven door 12 comprises the door cover 32, the inner glass panel 34 and the wave choke element 20. Further, the oven door 12 comprises two door columns 40 and two intermediate glass panels 42. In FIG. 5 only one door column 40 is shown. In this example, the oven door 12 comprises two intermediate glass panels 42. In general, the oven door 12 may comprise an arbitrary number of intermediate glass panels 42. Moreover, the oven door 12 comprises spacer elements 44 for holding the intermediate glass panels 42.

Optionally, the frame part 24 of the wave choke system 20 may include a flange around the perimeter of the frame part 24 in order to obtain sufficient structural integrity. The curvature and the height of said flange may be used to fine-tune the frequency of highest microwave leakage suppression. The notches 26 in the wave choke elements 26 may suit said flange and enable an even more compact design.

The compact structure of the wave choke system 20 and the wave choke elements 26 allows the enlarged inner glass panel 34, so that the oven door 12 gets a larger see-through area. This may be optimized by either expanded mesh or perforated holes of arbitrary shape which may part of a blank for the frame part 22.

LIST OF REFERENCE NUMERALS

10 microwave oven
12 oven door
14 oven cavity
16 front frame
18 gasket
20 wave choke system
22 frame part
24 base plate
26 wave choke element
28 tab
30 choke section
32 door cover
34 inner glass panel
36 glue joint
38 reinforcement
40 door column
42 intermediate glass panel
44 spacer element
46 notch

The invention claimed is:

1. An oven door for a microwave oven or for an oven with microwave heating function, wherein the oven door comprises a wave choke system formed as or within a door frame of said oven door, the wave choke system encloses a see-through area of the oven door, the wave choke system includes a frame part and a plurality of wave choke elements, the frame part includes a base plate on which the wave choke elements are fastened, the base plate is arranged parallel to a main plane of the oven door, the wave choke elements are serially arranged along the frame part and enclose at least partially the see-through area of the oven door, each wave choke element being formed as a U-shaped metal stripe, and the series of wave choke elements on the base plate form a wavelike ribbon, wherein a notch is formed in the central portion of each wave choke element so that the central portion of each wave choke element is smaller than the open end portion of said wave choke element, wherein the notches of the wave choke elements are provided for receiving an inner glass panel of the oven door, and wherein at least two neighboring wave choke elements arranged along one side of the oven door include aligned notches for receiving a common edge of the inner glass panel.

2. The oven door according to claim 1, wherein the oven door comprises a door cover extending over an outer portion of an inner side of said oven door.

3. The oven door according to claim 2, wherein the door cover of the oven door is formed as an L-shaped profile part and extends further over at least partially the circumferential sides of the oven door.

4. A microwave oven or an oven with microwave heating function, comprising at least one oven door according to claim 1.

5. The microwave oven or the oven with microwave heating function according to claim 4, comprising a front frame enclosing a front opening of an oven cavity, wherein said front frame is made of metal and forms a counterpart of the wave choke system.

6. The microwave oven or the oven with microwave heating function according to claim 5, wherein the door cover and an outer portion of the inner glass panel of the oven door are arranged in front of the front frame in a closed state of said oven door.

7. The microwave oven or the oven with microwave heating function according to claim 6, wherein a gap is formed between the front frame on the one hand and the door cover and the outer portion of the inner glass panel on the other hand in said closed state of the oven door.

8. The microwave oven or the oven with microwave heating function according to claim 5, wherein the front frame forms the counterpart of the wave choke system of the oven door, so that microwaves penetrating between the front frame and the oven door are conducted to the wave choke system (20).

9. The microwave oven or the oven with microwave heating function according to claim 4, wherein a width of a gap between the microwave oven and the oven door is suitable for receiving an elastic gasket being thick enough for acting as a steam-tight seal.

10. The microwave oven or the oven with microwave heating function according to claim 9, wherein the width of the gap between the microwave oven and the oven door is between 2 mm and 4 mm in the closed state of the oven door.

11. The microwave oven or the oven with microwave heating function according to claim 10, the width of said gap being about 3 mm.

12. The microwave oven or oven with microwave heating function according to claim 4, wherein the wave choke elements extend from the base plate in the direction of the inner side of the oven door.

13. The microwave oven or oven with microwave heating function according to claim 4, wherein each wave choke element includes two open end portions and the base plate includes a series of slots, wherein each open end portion of each wave choke element penetrates one slot of the base plate.

14. The microwave oven or oven with microwave heating function according to claim 13, wherein the open end of the wave choke element includes at least one tab penetrating through the corresponding slot in the base plate.

15. The microwave oven or the oven with microwave heating function according to claim 14, comprising at least one gasket, wherein said gasket is clamped between the front frame and the outer portion of the inner glass panel in a closed state of the oven door.

16. The microwave oven or oven with microwave heating function according to claim 15, said gasket being made of silicone.

17. The microwave oven or oven with microwave heating function according to claim 13, wherein each wave choke element is fastened at the base plate by deformation of the at least one tab and/or by twisting the at least one tab and/or by welding the open end portions at said base plate.

18. The oven door according to claim 1, wherein the wave choke elements extend from the base plate in the direction of the inner side of the oven door.

19. The oven door according to claim 1, wherein each wave choke element includes two open end portions and the base plate includes a series of slots, wherein each open end portion of each wave choke element penetrates one slot of the base plate.

20. The oven door according to claim 19, wherein the open end of each wave choke element includes at least one tab penetrating through the corresponding slot in the base plate.

21. The oven door according to claim 20, the open end of each wave choke element comprising at least two said tabs.

22. The oven door according to claim 19, wherein each wave choke element is fastened at the base plate by deformation of the at least one tab and/or by twisting the at least one tab and/or by welding the open end portions at said base plate.

* * * * *